US009698552B2

(12) United States Patent
Kitamura et al.

(10) Patent No.: US 9,698,552 B2
(45) Date of Patent: Jul. 4, 2017

(54) CONNECTOR

(71) Applicants: AUTONETWORKS TECHNOLOGIES, LTD., Yokkaichi-shi, Mie (JP); Sumitomo Wiring Systems, Ltd., Yokkaichi-shi, Mie (JP); SUMITOMO ELECTRIC INDUSTRIES, LTD., Osaka-shi, Osaka (JP)

(72) Inventors: Keishi Kitamura, Yokkaichi (JP); Yoshihiro Mizutani, Yokkaichi (JP); Yasuto Takeda, Yokkaichi (JP); Hiroki Hirai, Yokkaichi (JP); Tetsuji Tanaka, Yokkaichi (JP); Hiroyoshi Maesoba, Yokkaichi (JP); Kosuke Sone, Yokkaichi (JP); Teruo Kato, Anjo (JP); Kazuhisa Nimura, Anjo (JP)

(73) Assignees: AUTONETWORKS TECHNOLOGIES, LTD., Yokkaichi, Mie (JP); SUMITOMO WIRING SYSTEMS, LTD., Yokkaichi, Mie (JP); SUMITOMO ELECTRIC INDUSTRIES, LTD., Osaka-Shi, Osaka (JP)

( * ) Notice: Subject to any disclaimer, the term of this patent is extended or adjusted under 35 U.S.C. 154(b) by 0 days.

(21) Appl. No.: 14/909,781

(22) PCT Filed: Jul. 22, 2014

(86) PCT No.: PCT/JP2014/069332
§ 371 (c)(1),
(2) Date: Feb. 3, 2016

(87) PCT Pub. No.: WO2015/019844
PCT Pub. Date: Feb. 12, 2015

(65) Prior Publication Data

US 2016/0190755 A1 Jun. 30, 2016

(30) Foreign Application Priority Data

Aug. 9, 2013 (JP) ..... 2013-166753

(51) Int. Cl.
*H01R 35/04* (2006.01)
*H01R 13/506* (2006.01)
(Continued)

(52) U.S. Cl.
CPC ..... *H01R 35/04* (2013.01); *H01R 13/506* (2013.01); *H01R 13/567* (2013.01); *H01R 13/582* (2013.01)

(58) Field of Classification Search
USPC ..... 439/11, 404, 419, 544, 34, 248
See application file for complete search history.

(56) References Cited

U.S. PATENT DOCUMENTS 4,697,863 A * 10/1987 Galloway ..... B60R 16/0238 439/516
5,672,000 A * 9/1997 Lin ..... F21V 21/002 362/241

(Continued)

FOREIGN PATENT DOCUMENTS

JP 2-104581 8/1990
JP 6-68356 9/1994

(Continued)

OTHER PUBLICATIONS

International Search Report.

*Primary Examiner* — Alexander Gilman
(74) *Attorney, Agent, or Firm* — Gerald E. Hespos; Michael J. Porco; Matthew T. Hespos

(57) ABSTRACT

A plurality of connector (40) is configured to be maintained in a state of being aligned in an aligned direction. The connectors (40) each include a housing (41) that may be angularly displaced about an axis parallel to a fitting direc- (Continued)

tion with a counterpart housing (71). A plurality of the housings (41) are aligned in a direction intersecting the fitting direction and an angular displacement direction, and each has a through portion (52) through which electrical wires (100) for aligning the housings (41) in the aligned direction penetrates. A relieving portion (90) having a shape retracting in a direction for avoiding interference with the electrical wires (100) when the housings (41) are angularly displaced is provided on an inner face of each through portion (52).

6 Claims, 16 Drawing Sheets

(51) Int. Cl.
*H01R 13/56* (2006.01)
*H01R 13/58* (2006.01)

(56) References Cited

U.S. PATENT DOCUMENTS 5,695,259 A * 12/1997 Isshiki ..... B60R 16/0239 303/119.2
6,196,856 B1 * 3/2001 De Villeroche ... H01R 13/6315 439/248
6,566,824 B2 * 5/2003 Panagotacos ..... F21V 5/04 315/183
7,070,443 B2 * 7/2006 Tashiro ..... F21S 48/212 439/404
7,210,957 B2 * 5/2007 Mrakovich ..... F21S 4/001 439/404
7,429,186 B2 * 9/2008 Mrakovich ..... F21V 21/002 439/404
8,128,427 B2 * 3/2012 Mochizuki ..... F21S 48/212 439/419
9,457,741 B2 * 10/2016 Sasaki ..... B60R 16/0207
9,464,780 B2 * 10/2016 Huang ..... F21V 5/04
2005/0142942 A1 * 6/2005 Hayashi ..... H01R 13/6592 439/607.01
2013/0149888 A1 * 6/2013 Dozier ..... H01R 25/145 439/361

FOREIGN PATENT DOCUMENTS

JP 3018761 9/1995
JP 8-223737 8/1996
JP 2005-129355 5/2005
JP 2011-249038 12/2011

* cited by examiner

CONNECTOR

BACKGROUND

1. Field of the Invention

The present invention relates to a connector.

2. Description of the Related Art

JP 2011-249038 A discloses a wire harness configured of a plurality of temporally binding harnesses. Connectors are provided at both ends of each temporally binding harness via terminals connected to both ends of electrical wires. Each connector is provided at a distal end of a branched line of the wire harness, and each of them is configured capable of fitting with its counterpart connector.

In the above case, if the branched line is not correctly branched at a predetermined position in a length direction of the wire harness, the connector cannot face the one that is to be the fitting counterpart among the plurality of counterpart connectors, and there is a risk that the fitting work to its counterpart connector might be mistaken.

With respect to this, if the connectors are aligned by an aligning member that penetrates therethrough in their aligned direction, the connectors can face their counterpart connectors that are to be the fitting counterpart of themselves, and a fitting work with the counterpart connectors can be performed quickly. However, for example, if the connectors have a configuration in which they are angularly displaced about an axis parallel to a fitting direction with their counterpart connectors, the connectors interfere with the aligning member at parts where the aligning member is passed through, and in some cases the aligning member may be bent and deformed, and there is a risk that an aligned state of the connectors may not be maintained.

The present invention has been completed based on the above circumstance, and aims to maintain the state in which the plurality of connectors is aligned in an aligned direction.

SUMMARY

The present invention includes a housing which is allowed to be angularly displaced about an axis parallel to a fitting direction with a counterpart housing, wherein a plurality of the housings is aligned in a direction intersecting the fitting direction and an angular displacement direction, each of the housings includes a through portion through which an aligning member for aligning the housings in their aligning direction penetrates, and a relieving portion is provided on an inner face of each through portion, the relieving portion having a shape so as to retract in a direction along which an interference with the aligning member is avoided when the housing is angularly displaced.

Since the housings do not greatly interfere with the aligning member by the relieving portions having the shape that retracts away from the aligning member even when the housings are displaced in their angles, the plurality of housings are maintained stably in the state of being aligned in the aligned direction.

DETAILED DESCRIPTION

Figure 1:
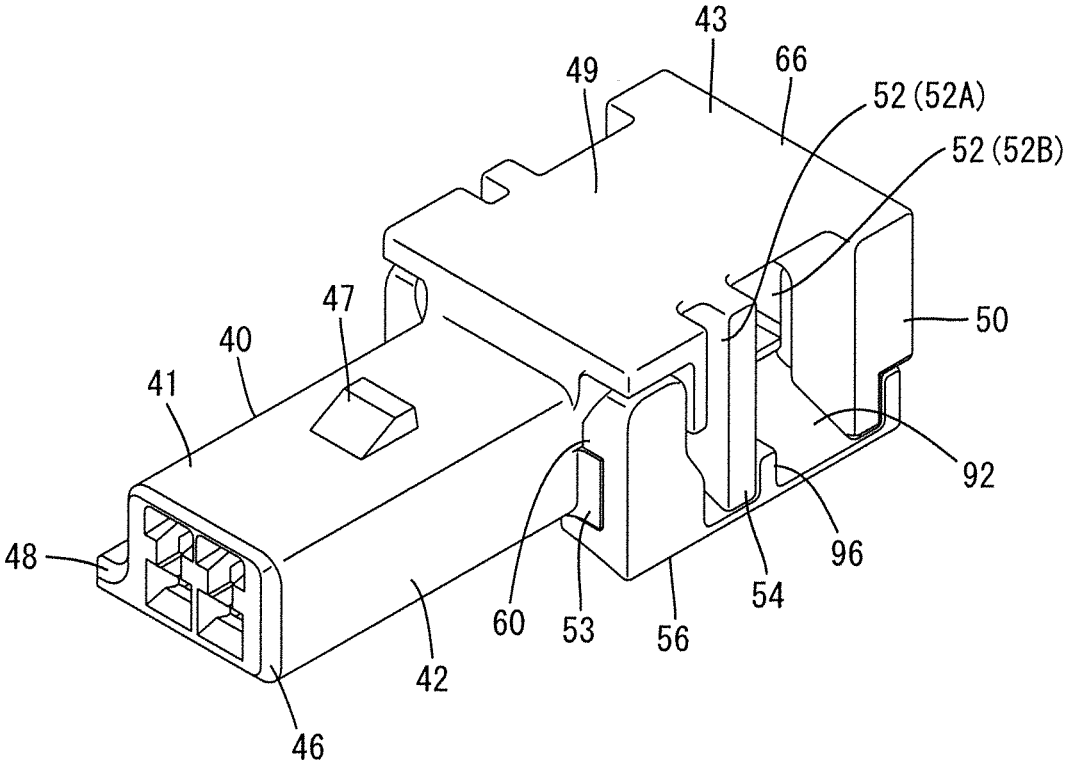
FIG. 1 is a perspective view of a connector of Example 1.

Preferred Examples of the present invention will be described hereinbelow.

The aligning member may be configured of an electrical wire extending out from each of the housings. A large number of electrical wires can be passed through the through portion by the relieving portion having the shape that retracts away from the electrical wires, and rigidity as an aligning member can be ensured. Further, anything dedicated as the aligning member does not need to be provided, so the configuration can be simplified.

Each of the housings may be configured of a housing portion formed with an operating opening for passing the electrical wires in the through portion and a cover, and the operating opening may be closed by the cover after the electrical wires are passed in the through portion. According to this, the work to pass the electrical wire in the through portion via the operating opening can be performed smoothly. Further, by the operating opening being closed by the cover, the electrical wire can surely be prevented from falling out from the through portion.

The angular displacement direction of the housings may include a first periaxial direction about the axis and a second periaxial direction about the axis which is an opposite direction of the first periaxial direction, and each of the relieving portions may be configured of a first inclination face that is inclined along a length direction of the aligning member when the angular displacement in the first periaxial direction occurs, and a second inclination face that is inclined along the length direction of the aligning member when the angular displacement in the second periaxial direction occurs intersecting the inclination direction of the first inclination face. Due to this, even if the housing is angularly displaced to either the first periaxial direction or the second periaxial direction, the housing does not greatly interfere with the aligning member.

Each of the housings may include first and second outer faces that form an outer face inclined along an attached object upon fitting with the counterpart housing, and the first and second inclination faces may form shapes so as to be inclined in inclination directions of the first and second outer faces at positions opposite to the first and second outer faces. Even with the first and second inclination faces being provided, the first and second outer faces are positioned opposite to the first and second inclination faces, so the housing does not unnecessarily become large in the inclination directions of the first and second inclination faces.

The first inclination face and the second inclination face may be inclined on both sides across a center in the width direction of the through portion in enlarging directions increasing an internal volume of the through portion from the center toward both ends in the width direction. Since the internal volume of the through portion is increased by the first inclination face and the second inclination face, so the number of the electrical wires to be passed through the through portion can be increased.

Example 1

Figure 16:
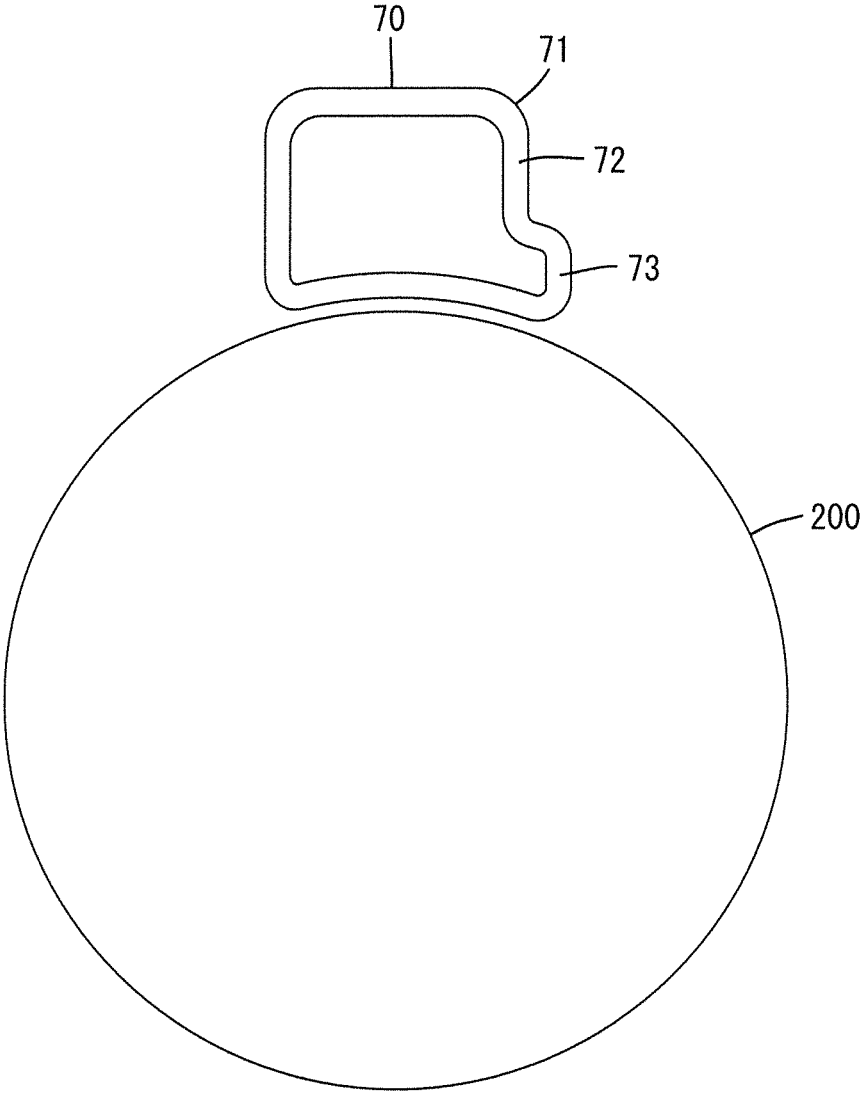
FIG. 16 is a schematic diagram of a counterpart connector provided on the solenoid.

Connectors 40 of the present Example are configured capable of fitting with their counterpart connectors 70. As illustrated in FIG. 16, the counterpart connectors 70 are provided on an outer circumferential face of a cylindrical solenoid 200. Although not shown in detail, a plurality of solenoids 200 are mounted on the component that configures an automatic transmission, so as to be aligned in the direction intersecting the front-rear direction (fitting direction) along the side edge of the component. Due to this, the counterpart connector 70 and the connector 40 to be fitted with this counterpart connector 70 are aligned in pluralities in the direction intersecting the front-rear direction.

Specifically, the counterpart connectors 70 each have a counterpart housing 71 made of a synthetic resin. As illustrated in FIG. 16, the counterpart housing 71 has a tubular hood 72. A counterpart terminal metal fitting, not illustrated, is projected into the hood 72. An expanding portion 73 is provided at the lower end of one side face of the hood 72 so as to be bulged sidewise.

Figure 4:
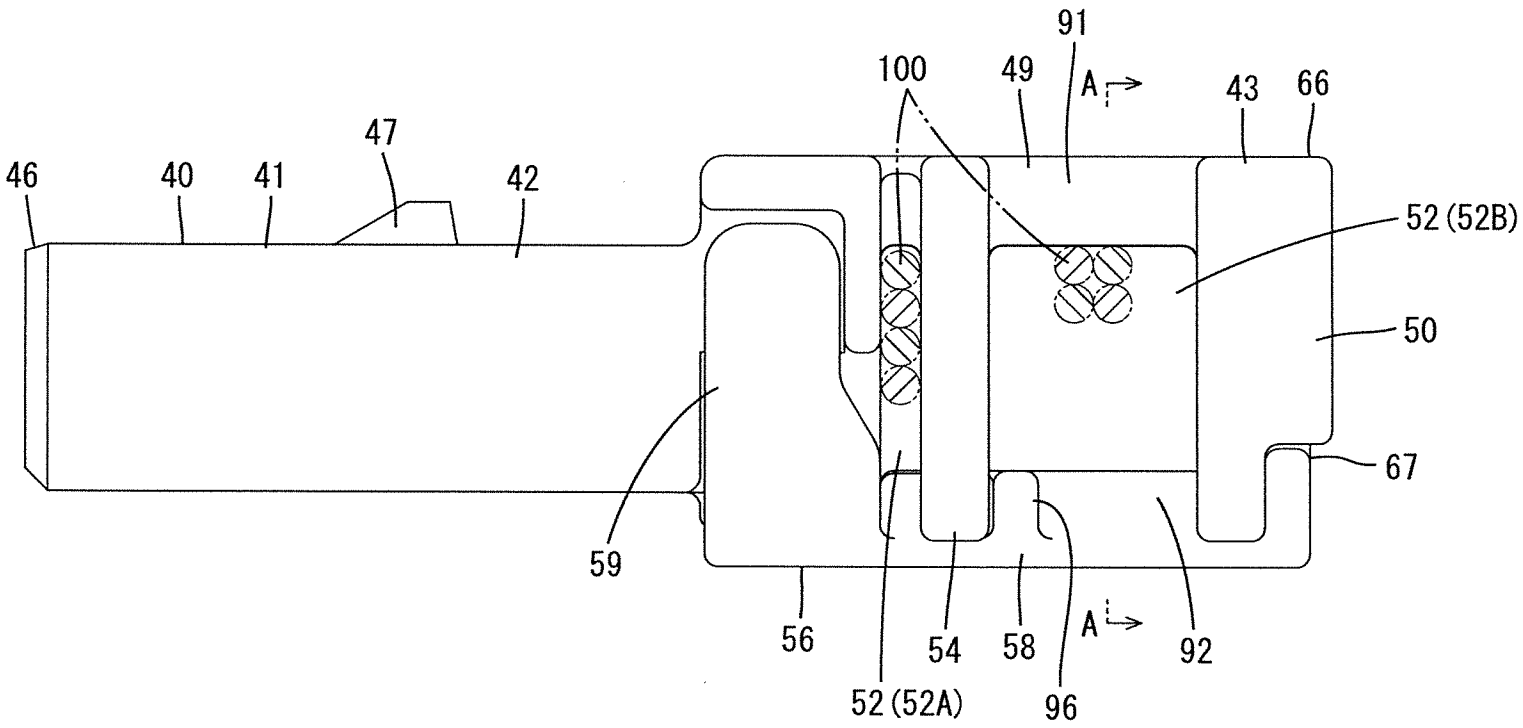
FIG. 4 is a side view of the connector.

Next, the connectors 40 will be described. A connector 40 has a housing 41 made of a synthetic resin. As illustrated in FIGS. 1 and 4, the housing 41 has a housing body 42, and a guide 43. The housing body 42 has a square block shape elongated in the front-rear direction. The guide 43 has a bent plate shape, and is disposed rearward of the housing body 42.

The housing body 42 can be fitted into a hood 72 of a counterpart connector 70 from the front side. The housing body 42 is provided with a cavity 44 therein into which a terminal metal fitting 30 (see FIG. 15) can be inserted from the rear side. A plurality of cavities 44 are aligned in the width direction. A lance 45 is projected from the upper face of the inner wall of each cavity 44. The terminal metal fitting 30 connected to terminal portion of an electrical wire 100 is inserted into the cavity 44 from the rear side, and the terminal metal fitting 30 that has been regularly inserted is resiliently engaged by the lance 45. Thus, the terminal metal fitting 30 is held in the cavity 44 so as not to fall off therefrom.

In the case of Example 1, a main line 10 (see FIG. 6) and a plurality of branching portions 20 (see FIG. 15) are provided. In the main line 10, routed are a plurality of electrical wires 100 extended out in the direction intersecting the front-rear direction. The branching portions 20 are spaced from each other in the extending-out direction of the main line 10. In the branching portions 20, some of the electrical wires 100 in the main line 10 are routed to be branched in the direction intersecting the main line 10 (front-rear direction). The connectors 40 are provided at ends of the branching portions 20. As illustrated in FIG. 4, the electrical wires 100 routed in the main line 10 and the branching portions 20 are configured to be passed through portions 52 to be described later of the guides 43 of the connectors 40.

Further, a tapered chamfered portion 46 is provided throughout the outer edge of the front face of the housing body 42. At fitting both the housings 41, 71, the housing body 42 is guided into the hood 72 along the chamfered portion 46.

A lock 47 is projected from the upper face of the housing body 42. The lock 47 is engaged with the counterpart housing 71, and holds both the housings 41, 71 in a fitted state at fitting both the housings 41, 71. A projection piece 48 is provided at the front end of the housing body 42 so as to be bulged sidewise from the lower end of one side face of the housing body 42. At fitting both the housings 41, 71, the projection piece 48 is inserted into an expanding portion 73 of the counterpart housing 71. At fitting both the housings 41, 71, if the housing body 42 is oriented in the direction reverse to its normal fitting direction, the projection piece 48 is abutted on the opening edge of the hood 72, and cannot be inserted into the expanding portion 73, thereby restricting the fitting operation of both the housings 41, 71. This can prevent the housing 41 oriented in the wrong fitting direction from being fitted into the counterpart housing 71.

Figure 14:
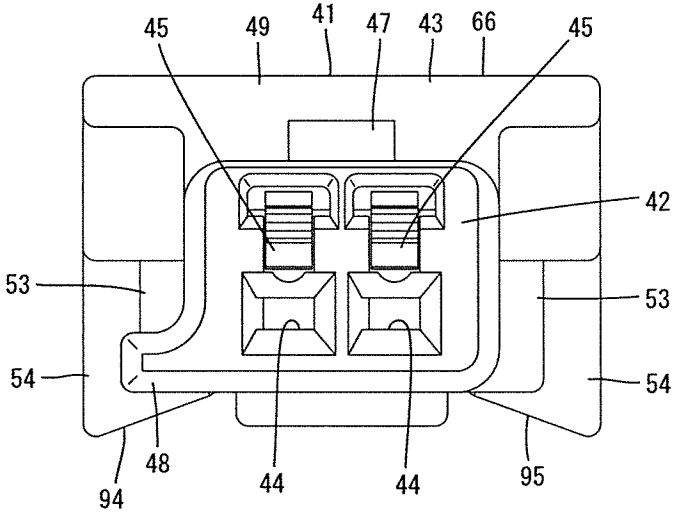
FIG. 14 is a front view of a housing portion.
Figure 15:
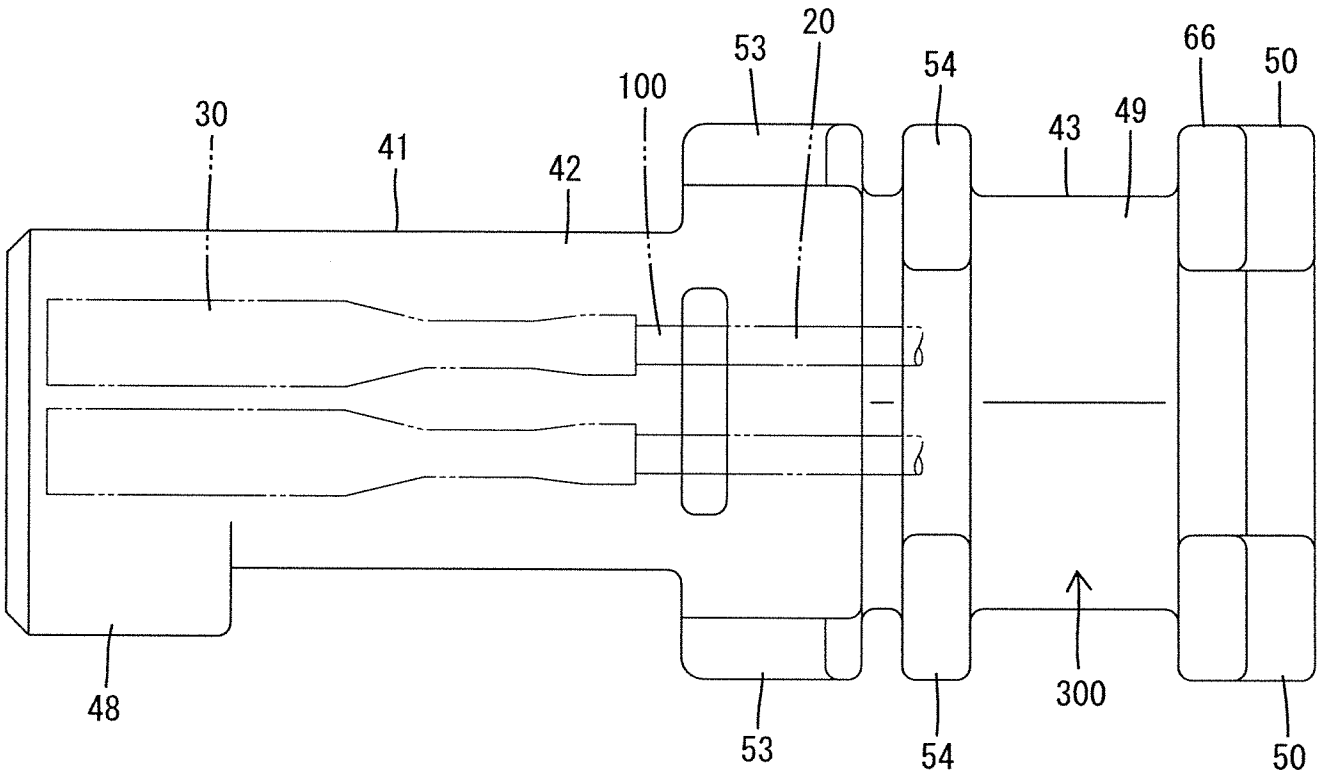
FIG. 15 is a bottom view of a housing portion.

Further, as illustrated in FIGS. 14 and 15, a pair of cover lock receiving portions 53 are projected from the lower portions at the rear ends of both the side faces of the housing body 42. Both the cover lock receiving portions 53 are flat, are projected rectangularly in side view, and can be engaged with later-described cover locks 59 of a cover 56 provided in the guide 43.

Figure 13:
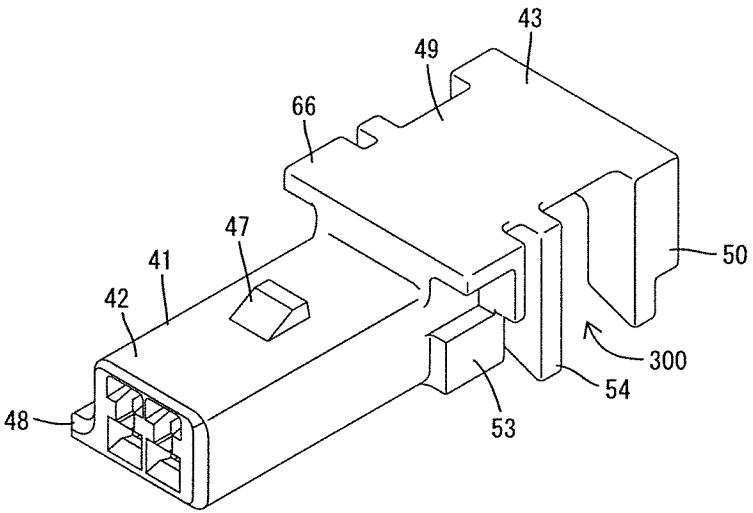
FIG. 13 is a perspective view of a housing portion.

As illustrated in FIGS. 13 and 15, the guide 43 has a base 49, a pair of partitioning portions 54, a pair of arms 50, and the cover 56. The base 49 is connected integrally to the upper edge at the rear end of the housing body 42, and is projected rearward so as to be bulged to both sides in the width direction from the housing body 42. Both the partitioning portions 54 are projected downward from both ends in the width direction on the front end side of the base 49. Both the arms 50 are projected downward from both side portions in the width direction at the rear end of the base 49. The cover 56 is separated from the base 49, both the partitioning portions 54, and both the arms 50. In the following description, the portions of the housing 41 except for the cover 56, that is, the housing body 42, the partitioning portions 54, the base 49, and the arms 50, are referred to as a housing portion 66. The housing portion 66 has a lower face opening of the guide 43 that is at a position facing the base 49 and formed with an operating opening 300 for inserting the electrical wire 100 through, as will be described later.

Figure 3:
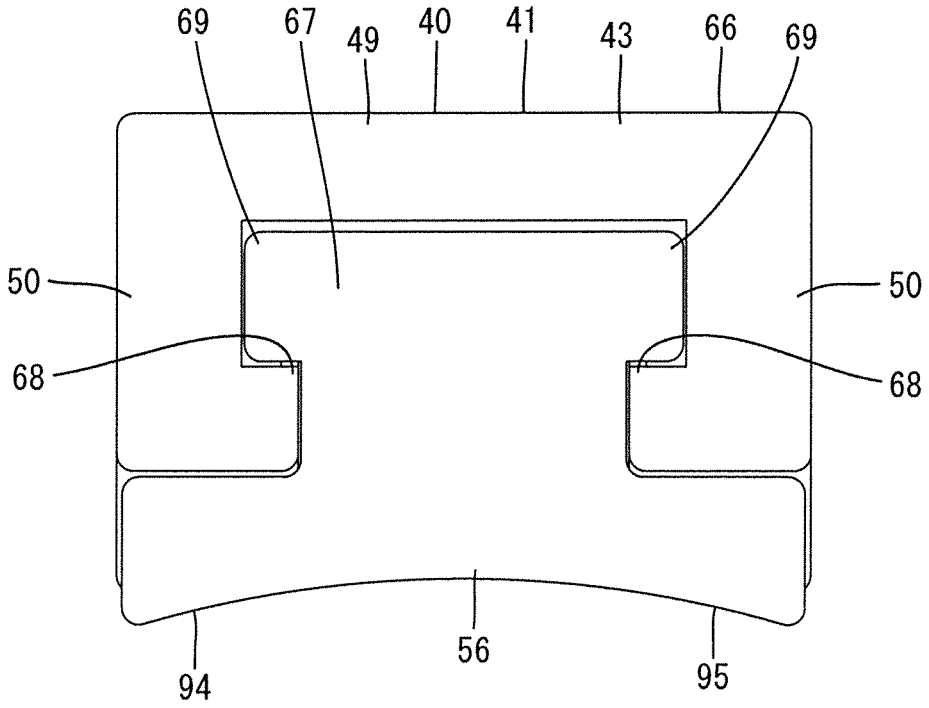
FIG. 3 is a rear view of the connector.

Both the partitioning portions 54 have a plate shape, and are disposed toward the rear face of the housing body 42 relative to the front-rear direction. As illustrated in FIG. 4, in side view, the opening dimension between the partitioning portion 54 and the rear face of the housing body 42 is equal to or slightly larger than the diameter dimension of one electrical wire 100. Both the arms 50 are disposed rearward of both the partitioning portions 54 so as to be opposite to each other, and are defined in a shape which can fit a later-described rear plate 67 of the cover 56. As illustrated in FIG. 3, a pair of inward projections 68 are provided at the lower ends of both the arms 50, and are projected inward so as to be opposite to each other.

Figure 9:
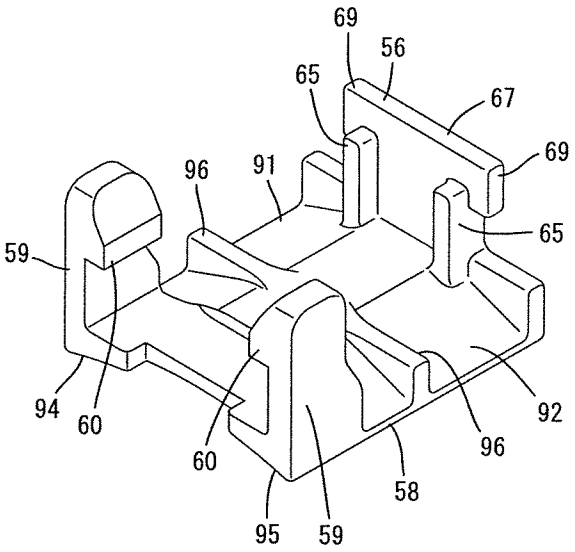
FIG. 9 is a perspective view of a cover.
Figure 10:
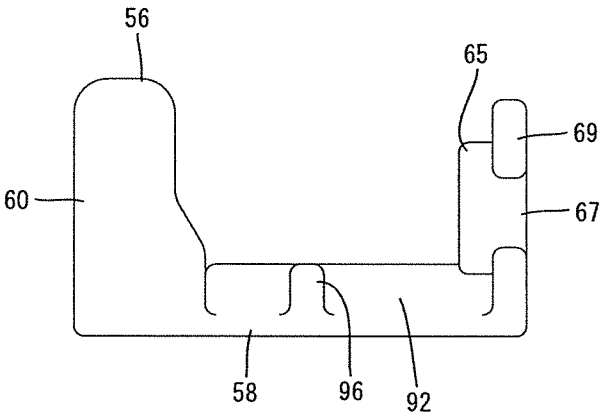
FIG. 10 is a side view of a cover.
Figure 11:
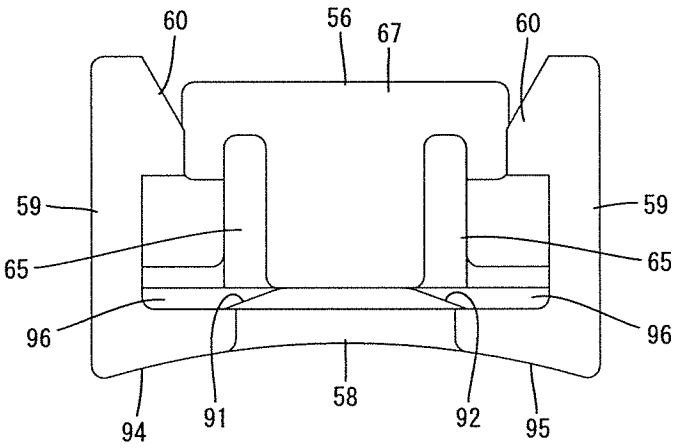
FIG. 11 is a front view of a cover.
Figure 12:
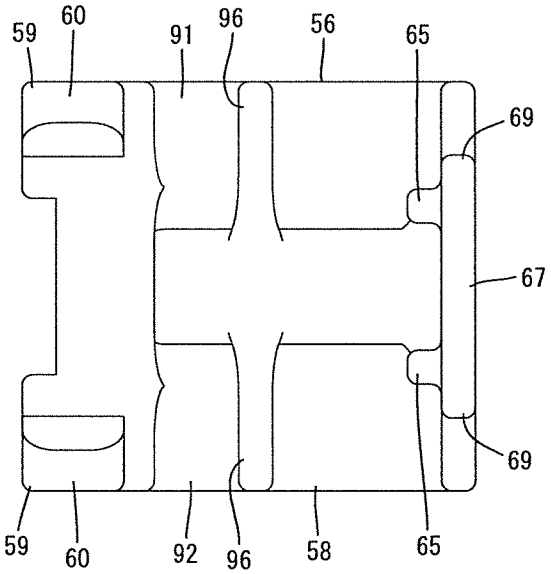
FIG. 12 is a plan view of a cover.

As illustrated in FIGS. 4 and 9, the cover 56 has a facing base 58, the rear plate 67, and a pair of cover locks 59. The facing base 58 has a curved plate shape, and faces the base 49 when the cover 56 is mounted on the housing portion 66. The rear plate 67 is projected upward from the center in the width direction at the rear end of the facing base 58. Both the cover locks 59 are projected upward from both ends in the width direction at the front end of the facing base 58. Pawl-shaped engaging projections 60 are provided at the upper ends of both the cover locks 59, and are projected inward.

Figure 2:
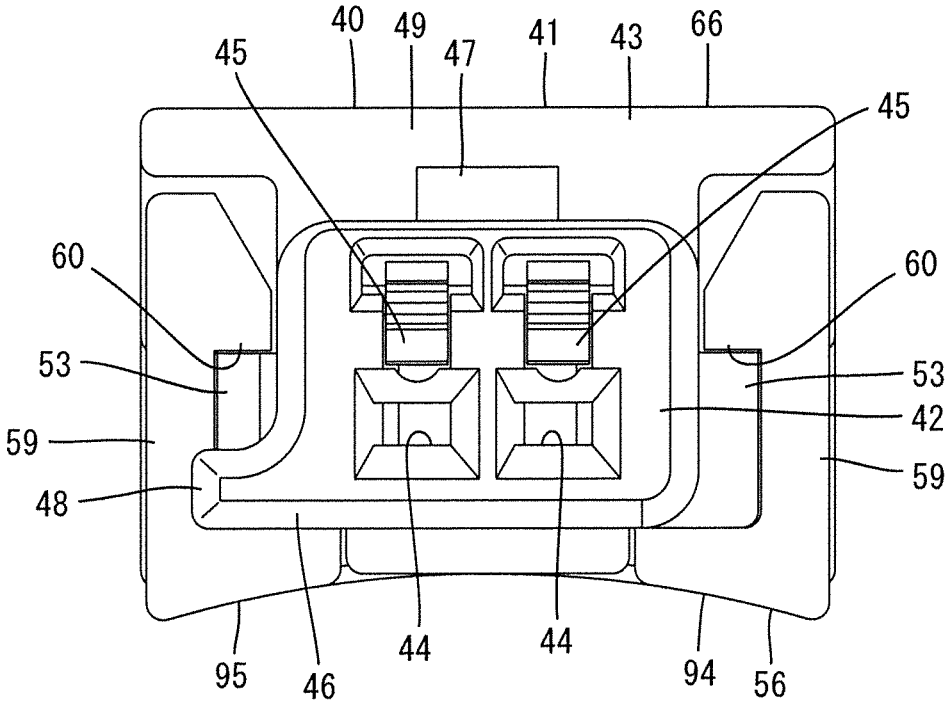
FIG. 2 is a front view of the connector.

Engaging ribs 65 along the height direction are projected at both ends in the width direction of the front face of the rear plate 67. A pair of outward projections 69 are provided at the upper end of the rear plate 67 so as to be bulged to both sides in the width direction. In a state where, as illustrated in FIG. 3, the outward projections 69 are engaged with the inward projections 68, the rear plate 67 is fitted while the engaging ribs 65 are abutted on the inner sides of both the arms 50. The engaging projections 60 of the cover locks 59 are resiliently engaged with the upper ends of the cover lock receiving portions 53, as illustrated in FIG. 2, so that the operating opening 300 is thereby closed by the cover 56 and the cover 56 is held by the housing portion 66. At this time, as illustrated in FIG. 4, the through portion 52 is defined between the cover 56 and the housing portion 66, and passes through the housing 41 in the width direction.

As illustrated in FIG. 4 the through portion 52, in side view, is closed throughout its periphery by the housing body 42, the base 49, the arm 50, the rear plate 67, and the facing base 58, and is separated into two chambers via the partitioning portion 54. Specifically, in side view, the through portion 52 has a first through portion 52A, and a second through portion 52B. The first through portion 52A is defined between the rear face of the housing body 42 and the partitioning portion 54, and has a narrow opening dimension. The second through portion 52B is defined between the partitioning portion 54 and the arm 50, and has a wide opening dimension. In the first through portion 52A, a plurality of electrical wires 100 are densely arranged in the height direction in a vertical row. In the second through portion 52B, a plurality of electrical wires 100 are arranged in the height direction and in the front-rear direction in a substantially interspersed manner. In particular, in the first through portion 52A, both the front and rear ends of each electrical wire 100 can be abutted on the rear face of the housing body 42 and both the partitioning portions 54. Thus, the electrical wires 100 are held so that the free movement of the electrical wires 100 in the front-rear direction is restricted.

Figure 5:
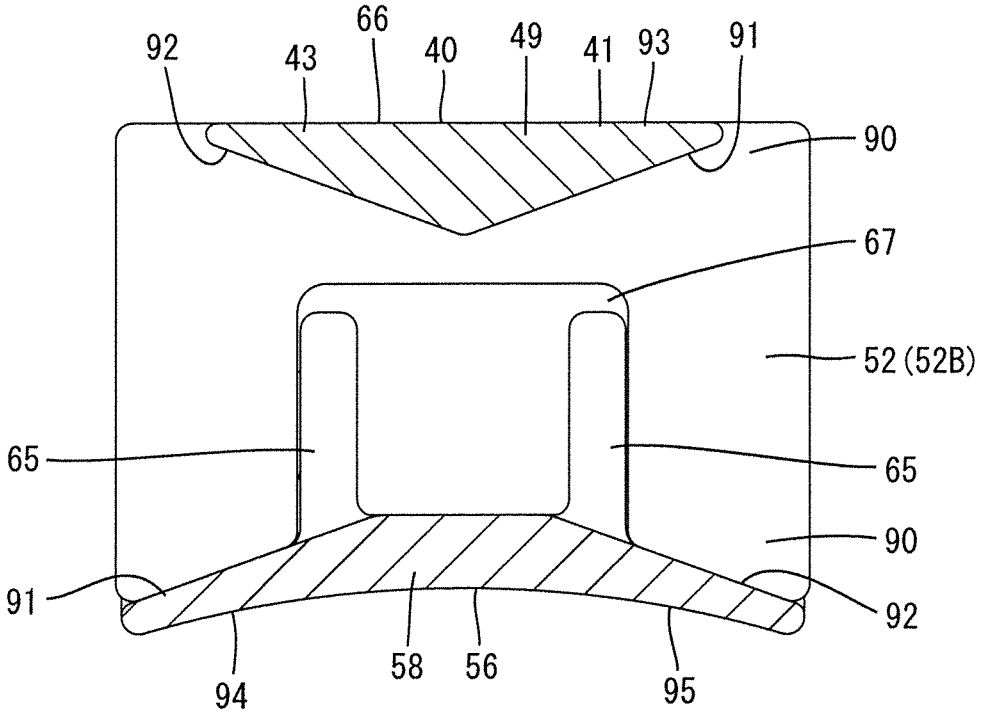
FIG. 5 is a cross-sectional view taken along line A-A in FIG. 4.
Figure 6:
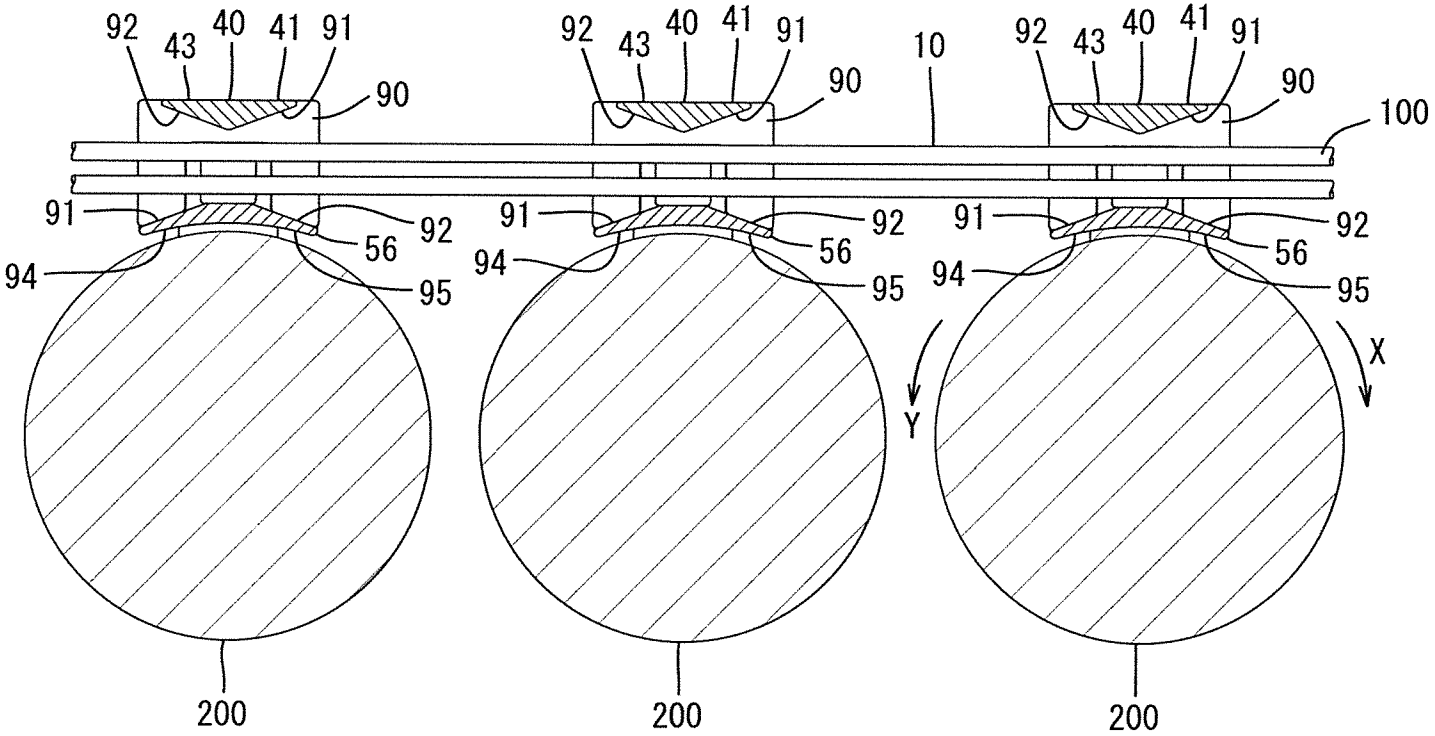
FIG. 6 is a cross-sectional view, seen in rear view, of the connectors fitted into respective corresponding counterpart connectors provided on solenoids.
Figure 7:
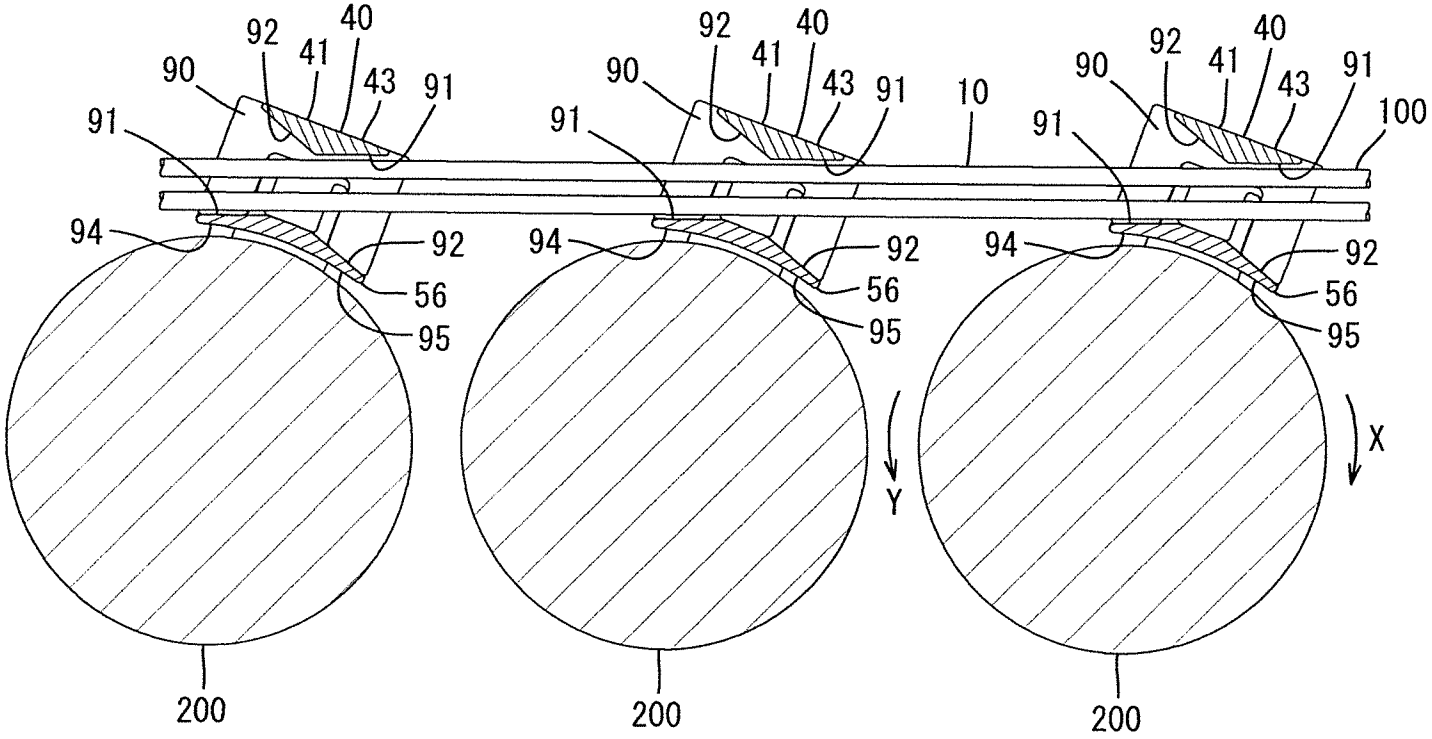
FIG. 7 is a cross-sectional view, seen in rear view, of the connectors when the solenoids are angularly displaced.

As illustrated in FIGS. 5 to 7, relieving portions 90 are provided in the through portion 52 of the housing 41. The relieving portions 90 have a shape retracted from the electrical wires 100 so as to be prevented from interfering with the electrical wires 100 when, as described later, the housing 41 is angularly displaced about the axis parallel with the front-rear direction. The relieving portions 90 are defined by first inclination faces 91 and second inclination faces 92. The first inclination faces 91 and the second inclination faces 92 are provided on the lower face of the base 49 and the upper face of the facing base 58 on the inner face of the through portion 52. Each first inclination face 91 and each second inclination face 92 are formed to be the tapered faces which are gradually inclined in the enlarging direction increasing the internal volume of the through portion 52 from the center toward both ends in the width direction, on both sides across the center in the width direction of the inner face of the through portion 52. In this case, the first inclination face 91 and the second inclination face 92 have substantially the same inclination angle.

As illustrated in FIG. 5, the upper face of the base 49 has a flat face 93 substantially along the width direction so as to be opposite to the first inclination face 91 and the second inclination face 92. Thus, the base 49 has a plate thickness which becomes smaller toward both ends in the width direction. A first outer face 94 and a second outer face 95 are provided at both ends in the width direction of the lower face of the facing base 58 so as to be opposite to the first inclination face 91 and the second inclination face 92. The first outer face 94 and the second outer face 95 are curved downward along the outer circumferential face of a solenoid 200. The inclination direction of the first outer face 94 is directed to the same side as the inclination direction of the first inclination face 91 of the facing base 58. The inclination direction of the second outer face 95 is directed to the same side as the inclination direction of the second inclination face 92 of the facing base 58. Thus, even when the inclination angle of the first inclination face 91 and the second inclination face 92 of the facing base 58 is somewhat acute, a predetermined plate thickness can be provided at both ends in the width direction of the facing base 58.

As illustrated in FIG. 9, restriction ribs 96 have a plate piece shape, and are projected from the first inclination face 91 and the second inclination face 92 of the facing base 58. The upper ends of both the restriction ribs 96 are located at the same height in the width direction, and are substantially flush and continuous with the center in the width direction of the upper face of the facing base 58. In short, both the restriction ribs 96 are disposed in the range of the inclination angle of the first inclination face 91 and the second inclination face 92.

As illustrated in FIG. 4, in a state where the cover 56 is held by the housing portion 66, both the restriction ribs 96 can be abutted on the rear faces at the lower ends of both the partitioning portions 54. Thus, the rearward flexing of both the partitioning portions 54 is restricted by both the restriction ribs 96. As a result, the first through portion 52A is precisely held with predetermined spacing, so that the arranged state of the electrical wires 100 inserted through the first through portion 52A is stably maintained.

The routing configuration of each electrical wire 100 inserted through the through portion 52 of the guide 43 will be described.

Before the cover 56 is mounted on the housing portion 66, the electrical wire 100 is inserted through the through portion 52 of the guide 43 via the operating opening 300. At this time, the electrical wire 100 to be branched to a branching portion 20 out of the electrical wires 100 is separated. The separated electrical wire 100 is passed through the first through portion 52A, and is inserted into a cavity 44 of the housing body 42 via the terminal metal fitting 30 from the rear side. The electrical wire remaining in a main line 10 is passed through the second through portion 52B, and is drawn out in two directions intersecting the front-rear direction through the openings at both ends of the second through portion 52B.

The cover 56 is mounted on the housing portion 66 from the lower side. Then, as illustrated in FIG. 4, the through portion 52 is sectioned between the cover 56 and the housing portion 66 so as to be closed in the peripheral direction. Thus, the electrical wire 100 can be prevented from falling off from the through portion 52.

In the above case, the electrical wires 100 passed through the through portion 52 of each housing 41 has a function as an aligning member that can retain its straightness in a wiring direction thereof (direction along which the connectors 40 align). Due to this, the housing 41 of the connector 40 for each branching portion 20 is arranged to face the corresponding counterpart connector 70 at the fittable position, and the fitting work to take place thereafter can be performed smoothly and quickly. Especially, since the electrical wires 100 are arranged tightly in the first through portion 52A while being in the free movement restricted state and the first through portion 52A is arranged at a position in proximity to the housing body 42, the shaft function of the electrical wires 100 passing through the first through portion 52A is exhibited effectively to surely prevent the connector 40 from swinging around.

Now in the case of Example 1, in a state where each connector 40 is fitted into the corresponding counterpart connector 70, the solenoid 200 is allowed to be angularly displaced about the axis parallel with the front-rear direction (the fitting direction of both the connectors 40, 70) in a predetermined angle range about the axial center of the solenoid 200.

Figure 8:
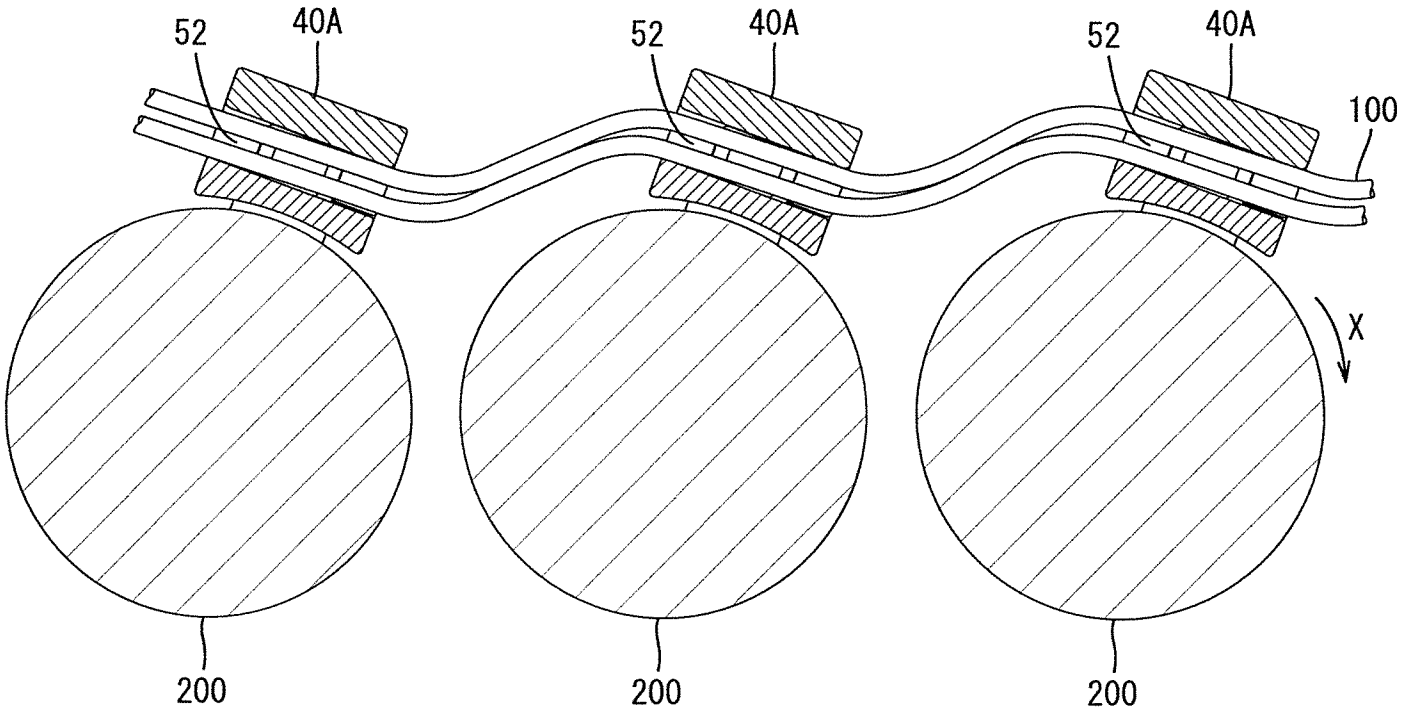
FIG. 8 is a diagram corresponding to FIG. 7 in a comparative example.

As illustrated in FIG. 8, if the inner faces of the through portions 52 are flat in the width direction which is the routing direction of the electrical wires 100, when the solenoids 200 are angularly displaced in a first periaxial direction X, which is the illustrated clockwise direction, the electrical wires 100 are forcefully bent and deformed along the flat inner faces of the through portions 52, so that the routing configuration is wavy in its entirety. Consequently, the electrical wires 100 cannot sufficiently align the connectors 40A in the aligning direction, and the number of the electrical wires 100 passed through the through portions 52 is restricted to be small.

Thus, according to Example 1, since the relieving portions 90 are provided in the through portions 52, when, as illustrated in FIGS. 6 and 7, the solenoids 200 are angularly displaced in the first periaxial direction X, the electrical wires 100 can be routed along the first inclination faces 91 of the through portions 52 substantially without being bent, and can maintain their straightness. When the solenoids 200 are angularly displaced in a second periaxial direction Y which is the counterclockwise direction, the electrical wires 100 are routed along the second inclination faces 92 of the through portions 52 substantially without being bent, and can maintain their straightness. Thus, when the solenoids 200 are angularly displaced in either of the first periaxial direction X and the second periaxial direction Y, the electrical wires 100 can have the aligning function of an aligning member and the number of the electrical wires 100 passed through the through portions 52 can be increased. In Example 1, when the solenoids 200 are angularly displaced to the maximum in the first periaxial direction X and the second periaxial direction Y, the first inclination face 91 and the second inclination face 92 can be abutted on the electrical wires 100 in substantially parallel.

As described above, according to Example 1, even when the housing 41 is angularly displaced, since the relieving portions 90 having a shape retracted from the electrical wires 100 can prevent the housing 41 from greatly interfering with the electrical wires 100, so the electrical wires 100 are prevented from bending and deforming. As a result, the alignment function by the electrical wires 100 is exhibited without any trouble, and the plurality of housings 41 are maintained stably in the state of being aligned in their aligned direction. Especially, since the electrical wires 100 serve the function as the aligning member, anything dedicated does not need to be provided as the aligning member, so the configuration can be simplified.

Further, the angularly displaced housings 41 do not greatly interfere with the electrical wires 100 even if the housings 41 are angularly displaced in either of the first periaxial direction X or the second periaxial direction Y together with the solenoid 200.

Furthermore, the first outer face 94 and the second outer face 95 that are inclined along the outer circumferential face of the solenoid 200 are provided at positions on the back side of the first inclination face 91 and the second inclination face 92 of the facing base 58, and since the first inclination face 91 and the second inclination face 92 respectively have shapes so as to be inclined in the inclination directions of the first outer face 94 and the second outer face 95 respectively, the housing 41 does not become unnecessarily large in the inclination directions of the first inclination face 91 and the second inclination face 92, and the facing base 58 can be made substantially with a uniform thickness.

<Other Examples>

The present invention is not limited to the Examples described above and in the drawings, and for example, Examples as follows are also included in the technical scope of the present invention.

(1) In Example 1, the electrical wires are used as the aligning member, however, according to the present invention a dedicated jig as the aligning member may pass through the through portions.

(2) In Example 1, the through portion is separated into two chambers, namely the first through portion and the second through portion, however, according to the present invention the through portion may be configured of only one chamber, or may be separated into three or more chambers.

(3) In Example 1, the cover is provided separately from the housing portion, however, according to the present invention the cover may be provided integrally with the housing portion via hinges, or the cover itself may be omitted, and a through portion may be provided at a rear end of the housing by penetrating therethrough.

REFERENCE SIGNS LIST

10: Main line
20: Branching portion
30: Terminal metal fitting
40: Connector
41: Housing
42: Housing body
43: Guide
52: Through portion
52A: First through portion
52B: Second through portion
70: Counterpart connector
71: Counterpart housing
72: Hood
90: Relieving portion
91: First inclination face
92: Second inclination face
100: Electrical wire (aligning member)
300: Operating opening

The invention claimed is:

1. A connector comprising:

a plurality of housings which is angularly displaceable about an axis parallel to a fitting direction with a counterpart housing the housings being aligned in a direction intersecting the fitting direction and an angular displacement direction, each of the housings includes a through portion through which an aligning member penetrates for aligning the housings in their aligning direction, the aligning member comprises electrical wires, at least one of the electrical wires extending out from each of the housings, and a relieving portion provided on an inner face of each through portion, the relieving portion having a shape so as to retract in a direction along which an interference with the aligning member is avoided when the housing is angularly displaced.

2. The connector according to claim 1, wherein each of the housings has a housing portion and a cover, the housing portion being formed with an operating opening for passing the electrical wires in the through portion, and the operating opening is closed by the cover after the electrical wires are passed in the through portion.

3. A connector, comprising:

a plurality of housings which is angularly displaceable about an axis parallel to a fitting direction with a counterpart housing the housings being aligned in a direction intersecting the fitting direction and an angular displacement direction, each of the housings includes a through portion through which an aligning member penetrates for aligning the housings in their aligning direction, and a relieving portion provided on an inner face of each through portion, the relieving portion having a shape so as to retract in a direction along which an interference with the aligning member is avoided when the housing is angularly displaced, wherein the angular displacement direction of each of the housings includes a first periaxial direction about the axis and a second periaxial direction about the axis, the second periaxial direction being opposite to the first periaxial direction, and each of the relieving portions includes a first inclination face that is inclined along a length direction of the aligning member when the angular displacement in the first periaxial direction occurs, and a second inclination face that is inclined along the length direction of the aligning member when the angular displacement in the second periaxial direction occurs intersecting the inclination direction of the first inclination face.

4. The connector according to claim 3, wherein the aligning member comprises electrical wires, at least one of the electrical wires extending out from each of the housings.

5. The connector according to claim 3, wherein each of the housings includes first and second outer faces that form an outer face that is inclined along an attached object upon fitting with the counterpart housing, and the first and second inclination faces form shapes so as to be inclined in inclination directions of the first and second outer faces at positions opposite to the first and second outer faces.

6. The connector according to claim 3, wherein the first inclination face and the second inclination face are inclined on both sides across a center in the width direction of the through portion in enlarging directions increasing an internal volume of the through portion from the center toward both ends in the width direction.

* * * * *